US007943066B2

(12) United States Patent
Ni et al.

(10) Patent No.: US 7,943,066 B2
(45) Date of Patent: May 17, 2011

(54) ELECTRICALLY CONDUCTIVE PAPER COMPOSITE

(75) Inventors: Yonghao Ni, Fredericton (CA); Bin Huang, Fredericton (CA); Guojun Kang, Fredericton (CA)

(73) Assignee: The University of New Brunswick, Fredericton, New Brunswick (CA)

( * ) Notice: Subject to any disclaimer, the term of this patent is extended or adjusted under 35 U.S.C. 154(b) by 0 days.

(21) Appl. No.: 11/905,856

(22) Filed: Oct. 4, 2007

(65) Prior Publication Data

US 2008/0142762 A1 Jun. 19, 2008

Related U.S. Application Data

(60) Provisional application No. 60/849,782, filed on Oct. 6, 2006.

(51) Int. Cl.
*H01B 1/20* (2006.01)
*D21F 11/00* (2006.01)

(52) U.S. Cl. ..... 252/519.32; 252/519.34; 252/500; 162/138; 427/121

(58) Field of Classification Search ..... 252/519.32, 252/519.34, 500; 162/138; 427/121
See application file for complete search history.

(56) References Cited

U.S. PATENT DOCUMENTS

| | | | | |
|---|---|---|---|---|
| 3,653,894 | A * | 4/1972 | Levy et al. | 430/63 |
| 3,694,202 | A * | 9/1972 | Sawyer et al. | 430/69 |
| 4,496,835 | A | 1/1985 | Boella et al. | |
| 4,521,450 | A | 6/1985 | Bjorklund et al. | |
| 4,604,427 | A | 8/1986 | Roberts et al. | |
| 4,617,228 | A | 10/1986 | Newman et al. | |
| 4,877,646 | A | 10/1989 | Kuhn et al. | |
| 5,006,574 | A * | 4/1991 | Sennett et al. | 523/351 |
| 5,178,730 | A * | 1/1993 | Bixler et al. | 162/168.3 |
| 5,211,810 | A | 5/1993 | Bartholomew et al. | |
| 5,336,374 | A | 8/1994 | Oka et al. | |
| 5,407,699 | A * | 4/1995 | Myers | 427/121 |
| 5,503,849 | A * | 4/1996 | Bilodeau | 428/448 |
| 5,779,857 | A | 7/1998 | Norlander | |
| 5,833,884 | A | 11/1998 | Child | |
| 5,968,417 | A | 10/1999 | Viswanathan | |
| 6,019,872 | A | 2/2000 | Kurrie | |
| 6,083,562 | A | 7/2000 | Rodriguez et al. | |
| 6,090,195 | A * | 7/2000 | Andersen et al. | 106/162.51 |
| 6,228,217 | B1 | 5/2001 | Dickerson et al. | |
| 6,402,826 | B1 * | 6/2002 | Yuan et al. | 106/486 |
| 2004/0241348 | A1 * | 12/2004 | Koga et al. | 428/32.1 |
| 2008/0017832 | A1 * | 1/2008 | Funaoka et al. | 252/500 |
| 2008/0102257 | A1 * | 5/2008 | Aho et al. | 428/211.1 |

OTHER PUBLICATIONS

"Thermal degradation of polypyrrole: effect of temperature and film thiciness", Truong, Elsevier Sqauoia, Synthetic Metals, 52 (1992), p. 33-44.

"XPS and Electrical Characterization of BF4 Doped Polypyrrole Exposed to Oxygen and Water", Erlandsson, Elsevier Sequoia, Synthetic Metals, 10 (1985) p. 303-318.

"Stability of chemically synthisized polyrrole films", Thieblemont et al, Elsevier Sequoia, Synthetic Metals, 59, (1993) p. 81-96.

"Some Properties of Polypyrrole-Paper Compositions", Bjorklund et al, Journal of Electonic Materials, vol. 13, No. 1, 1984, p. 211-230.

"Semiconducting and Metallic Polymers: The Fourth Generation of Polymeric Materials". Heeger, The Journal of Physical Chemistry, vol. 105, No. 36, Sep. 13, 2001 p. 8475-8491.

Preparation of conductive papaer by in-situ polymerization of pyrrole in a pulp fibre system, Huang et al, Pulp & Paper, (2006) p. 38-42.

Fibre engineering: The key to industry change, Baum, Solutions, Jul. 2002, p. 42-45.

Paper structure, Paper Physics, Niskanen, date unknown, col. 14-31.

"Conducting Polypyrrole by Chemical Synthesis in Water", Bocchi et al, Elsevier Sequoia, Synthetic Metals 24, (1998) p. 217-221.

"Kinetic Study of Pyrrole Polymerization with Iron (III) Chloride in Water" Planche et al, Journal of Applied Polymer Science, vol. 52, No. 13 (1994), p. 1867-1877.

Engineering of Fobre Surface Properties by Application of the Polyelectrolyte Multilayer Concept. Part I: Modification of Paper Strength, Wagberg et al, Journal of Pulp and Paper Science, vol. 28, No. 7, Jul. 7, 2002, p. 222-228.

"Polypyrrole overoxidation during its chemical synthesis", Thieblemont et al, Elsevier Science, Synthetic Metals, 66, (1994) p. 243-247.

"Effect of reagen concentrations used to synthesize polyprrole on the chemical characteristics and optical and electronic properties of the resulting polymers", Lei et al Elsevier Sequoia, Synthetic Metals, 46 (1992), p. 53-69.

"Chemical Sythesis of Highly Electrically Conductive Polypyrrole", Machida et al, Elsevier Sequoia, Synthetic Metals, 31, (1989) p. 311-318.

Adsoprtion at the Liquid/Solid Interface: Conductive Textiles Based on Polypyrrole, Kuhn, Textile and Colorist, Dec. 1997, p. 17-21.

Electrically Conductive Fibre Composites Prepared from Polypyrrole-Engineered Pulp Fibres, Huang et al, The Canadian Journal of Chemical Engineering, vol. 83, 2005, p. 896-903.

(Continued)

*Primary Examiner* — Douglas McGinty

(74) *Attorney, Agent, or Firm* — Lynn C. Schumacher; Hill & Schumacher

(57) ABSTRACT

The present invention provides electrically conductive paper composites prepared from cellulose fibers modified to bind a conducting polymer to a surface of the cellulose fibers and mixing these with unmodified cellulose fibers and forming paper products from the composite. Conducting paper composites so formed were investigated for their conductivity and strength properties as a function of monomer dosage or percentage of modified fibers in the mixture and for the composites it was found that less monomer (i.e. conductive polymer) was needed to achieve the same conductivity obtained from conducting paper made from only the modified cellulose. A higher tensile strength was obtained with the composite conducting paper than was attained with conducting paper made from only the modified cellulose. The electrically conductive paper composites may also be prepared from cellulose fibers mixed with particulate fillers modified to bind a conducting polymer to a surface of the particulate fillers.

13 Claims, 6 Drawing Sheets

OTHER PUBLICATIONS

Huang, Bin, "Preparation of Conductive Paper by In-Situ Polymerization of Pyrrole in a Pulp Fiber System", A Thesis Submitted in Partial Fulfillment of the Requirements of the Degree of Master of Science in Engineering, The University of New Brunswick, Dec. 2004, 129 pages.

Huang er al. "Preparation of conductive paper by in-situ polymerization of pyrrole in a pulp fiber system." Powerpoint lecture presented at Pulp and Paper Technical Association of Canada (PAPTAC) 91st Annual Meeting in Montreal, QC Canada. Feb. 7-10, 2005.

* cited by examiner

ELECTRICALLY CONDUCTIVE PAPER COMPOSITE

CROSS REFERENCE TO RELATED U.S. PATENT APPLICATION

This patent application relates to U.S. utility patent application Ser. No. 60/849,782 filed on Oct. 6, 2006 entitled ELECTRICALLY CONDUCTIVE PAPER COMPOSITE, filed in English, which is incorporated herein in its entirety by reference.

FIELD OF THE INVENTION

The present invention generally relates to electrically conductive paper composites prepared from pulp modified with a conducting polymer and unmodified pulp.

BACKGROUND OF THE INVENTION

Electrically conductive composite materials have applications such as electrostatic dissipation and electromagnetic shielding. They are manufactured by dispersing conductive fillers such as metal particles, carbon black, graphite or carbon fibers in a polymer matrix. With increasing environmental awareness around the world, materials that pose less threat to the environment are now receiving more and more attention from researchers and the industry.

As a renewable natural resource with good mechanical properties, cellulose fiber enjoys advantages over other polymeric materials in environmental friendliness. "Fiber engineering", described by Baum, is advocated as the "key to change" in pulp and paper industry[1]. Among the four recommended research areas, chemical modification of fibers and fiber surfaces[1] holds great potential for the development of fiber-based functional paper/hybrid materials. Various paths can be adopted to modify pulp fibers, such as self-assembly multilayer scheme[2], surface graft polymerization and surface coupling with smaller molecules, by introducing diverse functionalities with modest chemical usage. The engineered fibers can be potentially added into the conventional papermaking stock as "super-fiber fillers" to reduce overall cost. In the invention disclosed herein, intrinsically conducting polymer was introduced via an in-situ chemical polymerization route to impart electrical conductivity to the normally non-conductive (insulating) paper materials.

Electrically conducting polymers which include conjugated backbones and doping-induced charge carriers, are designated as the "fourth generation of polymeric materials"[3] and deemed as a milestone in the progress of science. With a diverse range of properties (e.g. electrochromic property) besides the high electrical conductivity, ICPs (intrinsically conducting polymers) can potentially be used for applications such as electrochromic displays, electroluminescent devices, chemical and electrochemical sensors, biosensors and membranes. However, conducting polymers tend to be insoluble and infusible, and the resulting poor post-synthesis processibility[3] has largely hindered their widespread commercial usage and exploitation. To solve this processing problem, various materials have been used as a carrier substrate by blending or through in-situ synthesis (chemically or electrochemically) of conducting polymers. Conductive textiles prepared by in-situ chemical polymerization of pyrrole are already commercially available[4].

By combining intrinsically conducting polymers (ICP) with a common processable substrate such as pulp fibers, the resulting hybrid materials will inherit the mechanical and other useful properties from the carrier substrates (e.g. the versatile formability) while maintaining the unique properties of the ICPs. Notably, the intractability of ICPs can be easily resolved by processing the engineered fibers into desired articles. Moreover, it is well known that cellulose fiber is a renewable natural resource with superior advantages over other polymeric materials in its environmental friendliness. The small amount of polymer introduced will not have much impact on the overall biodegradability of the material. Therefore, the engineered fibers can be manufactured into disposable or recyclable products for various applications. Even for lower-end applications such as electrostatic dissipation (ESD) packaging, with the contemplated increasing demand of paper packaging materials in the future, the potential market is quite attractive both from environmental and economic considerations. There are a number of studies on ICP-paper (wood fiber) hybrid materials[5;6]; however, they were fairly preliminary with no or little optimization or characterization.

U.S. Pat. No. 4,617,228 to Newman et al. discloses methods for the production of electrically conductive composites such as fiberglass fabrics, with a pyrrole polymer in the pores of the porous material using a method involving treating the porous substance with liquid pyrrole, and then using a strong oxidant in the presence of a non-nucleophilic anion so that the pyrrole monomer is oxidized to a pyrrole polymer that precipitates in the interstices of the porous material.

U.S. Pat. No. 4,496,835 to Maus et al. discloses an electrically conductive composite or structural material using a dielectric substrate such as fiberglass fabric, and a layer of a pyrrole polymer on the substrate. This is then treated with a solution of a strong oxidant containing a non-nucleophilic anion, after which the substrate is dried and then exposed with vapors of a pyrrole such that the pyrrole is oxidized by the strong oxidant which forms a polypyrrole layer or film on the substrate.

U.S. Pat. No. 4,877,646 issued to Kuhn et al. discloses methods for making electrically conductive textile materials. More particularly, fabrics are rendered electrically conductive by contacting the fabric with an aqueous solution of a pyrrole compound, an oxidizing agent and a doping agent or counter ion and then depositing onto the surface of individual fibers of the fabric a prepolymer of the pyrrole compound. The prepolymer is adsorbed into the surface of the textile to give a film electrically conductive polymerized compound on the textile.

U.S. Pat. No. 4,521,450 issued to Bjorklund et al. discloses methods of increasing the electrical conductivity of impregnable materials, such as cellulose-based insulating materials, by infiltrating and polymerizing a pyrrole compound such as pyrrole and N-methylpyrrole, to give a polymer with higher electrical conductivity than the impregnable material on the material.

U.S. Pat. No. 4,604,427 issued to Roberts et al. discloses methods for forming an electrically conductive polymer blend in which a non-porous, swellable or soluble host polymer is impregnated with a compound selected such as pyrrole, aniline and a chemical oxidant which is dissolved in a solvent capable of swelling or solubilizing the host polymer. Upon polymerization the porous material so impregnated has a conductive layer.

U.S. Pat. No. 6,019,872 issued to Kurrle discloses a paper product prepared from a bleached chemical papermaking furnish containing lignin containing fibers. Incorporating low concentrations of high lignin content fibers into a chemical paper produces a paper product which can be authenticated with a phloroglucinol stain.

U.S. Pat. No. 5,779,857 issued to Norlander discloses a method for producing defibrated cellulose product having a fibrous structure with good compressibility under the influence of heat and pressure. The structure is obtained by cross-linking, in a dry state, cellulose fibers which are impregnated with a cross-linking agent and a polyfunctional alcohol.

U.S. Pat. No. 5,833,884 issued to Child discloses a method of depositing a conductive polymer film on textile fabrics using oxidative polymerization of a pyrrole compound in the presence of a dopant anion and a stabilizing agent having the formula.

U.S. Pat. No. 5,968,417 issued to Viswanathan discloses conducting compositions, and fibers or fabrics with improved anti-static properties produced by contacting the fiber or fabric with a conductive composition of formaldehyde-based resins and curing the fiber or fabric. The conductive compositions include linearly conjugated pi.-systems and sulfonated polyaryl compounds in which aryl rings of the sulfonated polyaryl compound are substituted with hydroxy, methoxy, ethoxy, hydroxymethyl, or 2-hydroxyethoxy substituents.

U.S. Pat. No. 6,228,217 issued to Dickerson et al. discloses a process for making an aqueous papermaking suspension containing a polyelectrolyte complex. The process includes using an aqueous suspension of pulp fibers containing a water-soluble cationic polymer and a water-soluble anionic polymer which react in the aqueous suspension to form a polyelectrolyte complex and a multivalent cation having a +3 charge and forming the polyelectrolyte complex. The aqueous suspension of pulp fibers contains surface active carboxyl compounds and water-soluble anionic compounds. The aqueous papermaking suspension is then sheeted and dried to give paper exhibiting enhanced strength.

U.S. Pat. No. 6,083,562 issued to Rodriguez et al. discloses methods and compositions for making antistatic fibers. The process includes forming a polymeric fiber with the fiber including a conductive component having at least 15 wt % electrically conductive particles. The polymeric fiber thus formed is mixed with monomers of a conductive polymer for a time sufficient to suffuse the monomers into the fiber after which the monomers are polymerized to form a fiber with an interpenetrating conductive polymer phase which is the conductive polymer. The conductive fiber-forming polymer may be polypyrrole and polyaniline, in which the polymer is formed in situ and is interspersed among the carbon particles of the second component.

U.S. Pat. No. 5,211,810 issued to Bartholomew et al. discloses electrically conductive polymeric materials produced by suspending a fibrous based material and a monomer precursor of a conductive polymer in an aqueous solution to which a chemical oxidant is added thereby inducing polymerization of the monomer which results in the fibrous based material being coated. The products of the process are useful as microwave food packaging.

Therefore it would be very advantageous to provide electrically conductive paper composites prepared from pulp modified with a conducting polymer and unmodified pulp which can be formed into useable products such as conducting paper.

SUMMARY OF THE INVENTION

The present invention provides a method for producing electrically conductive paper composites prepared from pulp modified with a conducting polymer and unmodified pulp.

In one aspect of the invention there is provided an electrically conductive paper composite, comprising:

a mixture of cellulose fibers modified to have conductive polymer bound to a surface thereof, and unmodified cellulose fibers, said conductive polymer including a dopant incorporated therein, said dopant being selected from the group consisting of sulfonic acids and salts thereof, said electrically conductive paper composite characterized by a tensile strength greater than attained with an electrically conductive paper absent the unmodified cellulose fibers.

The modified cellulose fibers are present in an amount in a range from about 0.5 to about 20% by weight.

The present invention also provides a packing material comprising:

an electrically conductive paper composite which comprises cellulose fibers modified to include a conductive polymer bound to a surface thereof mixed with unmodified cellulose fibers, said conductive polymer including a dopant incorporated therein, said dopant being selected from the group consisting of sulfonic acids and salts thereof, said electrically conductive paper composite characterized by a tensile strength greater than attained with an electrically conductive paper absent the unmodified cellulose fibers.

The present invention also provides a method of producing an electrically conductive paper composite, comprising:

modifying cellulose fibers to bind an electrically conductive polymer to a surface thereof to form modified cellulose fibers by simultaneously adding monomers, an oxidant, and a dopant to untreated cellulose fibers, and initiating polymerization of said monomer in the presence of the dopant to form the electrically conducting polymer on the surface of the cellulose fibers to produce the modified cellulose fibers, said conductive polymer including a dopant incorporated therein, said dopant being selected from the group consisting of sulfonic acids and salts thereof;

mixing said modified cellulose fibers with unmodified cellulose fibers to form a composite cellulose mixture, said modified cellulose fibers present in an amount in a range from about 0.5 to about 20% by weight; and forming said composite cellulose mixture into paper sheets, said paper sheets being characterized by a tensile strength greater than a tensile strength attained with an electrically conductive paper absent the unmodified cellulose fibers.

The present invention also provides an electrically conductive paper composite comprising a mixture of cellulose fibers and clay particulate filler with surfaces modified to have a conductive polymer bound thereto to give conductive polymer coated clay particulate fillers, said conductive polymer including a dopant incorporated therein, said dopant being selected from the group consisting of sulfonic acids and salts thereof.

The present invention also provides an electrically conductive paper composite, comprising:

a mixture of cellulose fibers and particulate fillers selected from the group consisting of bentonite, talc and silica gel with surfaces modified to have a conductive polymer bound thereto to give conductive polymer coated particulate fillers, said conductive polymer including a dopant incorporated therein, said dopant being selected from the group consisting of sulfonic acids and salts thereof.

The present invention also provides an electrically conductive paper composite, comprising:

a combination of cellulose modified with a conductive polymer bound thereto to be conducting and unmodified cellulose and particulate filler modified with said conductive polymer to give conductive polymer coated particulate fillers, and optionally unmodified particulate filler, wherein the particulate filler is selected from the group consisting of clay, bentonite, talc and silica gel, and said conductive polymer including a dopant incorporated therein, said dopant being selected from the group consisting of sulfonic acids and salts thereof.

A further understanding of the functional and advantageous aspects of the invention can be realized by reference to the following detailed descriptions and drawings.

BRIEF DESCRIPTION OF THE DRAWINGS

The invention will be more fully understood from the following detailed descriptions thereof taken in connection with the accompanying drawings, which form a part of this application, and in which.

DETAILED DESCRIPTION OF THE INVENTION

Figure 1A:
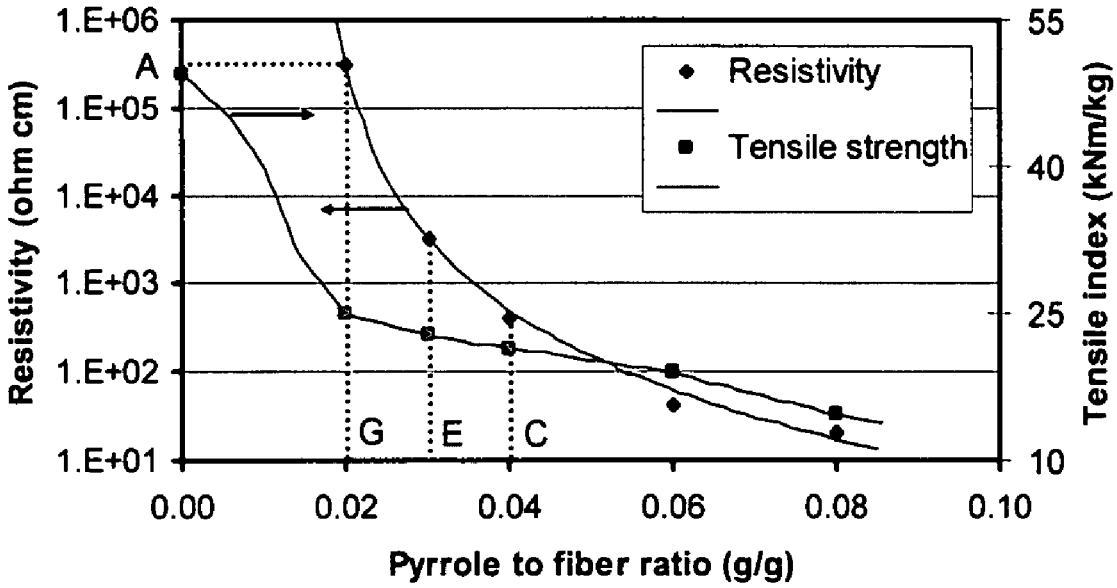
FIG. 1*a* shows plots of the electrical resistivity and tensile strength as a function of pyrrole to fiber ratio of paper sheets made from fibers treated with different pyrrole dosages (based on fibers) at medium fiber consistency, other reaction conditions: $FeCl_3$ to pyrrole molar ratio=3:1; AQSA to pyrrole molar ratio=1:3, AQSA means anthraquinone-2-sulfonic acid sodium salt.

Generally speaking, the systems described herein are directed to electrically conductive paper composites. As required, embodiments of the present invention are disclosed herein. However, the disclosed embodiments are merely exemplary, and it should be understood that the invention may be embodied in many various and alternative forms. The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention. For purposes of teaching and not limitation, the illustrated embodiments are directed to electrically conductive paper composites.

As used herein, the term "about", when used in conjunction with ranges of dimensions of particles or other physical properties or characteristics, is meant to cover slight variations that may exist in the upper and lower limits of the ranges of dimensions so as to not exclude embodiments where on average most of the dimensions are satisfied but where statistically dimensions may exist outside this region. It is not the intention to exclude embodiments such as these from the present invention.

The present invention provides electrically conductive paper composite and a method of producing the electrically conductive paper composites from pulp modified with a conducting polymer and unmodified pulp. Specifically, the electrically conductive paper composite comprises cellulose fibers which have been modified to include a conductive polymer bound to a surface thereof, and unmodified cellulose fibers.

Surprisingly, good electrical conductivity was obtained in paper composites in which the modified cellulose fibers are present in an amount in a range from about 0.5 to about 20% by weigh, and preferably in a range from about 0.5 to about 10% by weight, with the unmodified cellulose fibers making up the rest of the composite. The conducting polymer is preferably made from monomers such as, but not limited to pyrrole, substituted derivatives of pyrrole, aniline, substituted derivatives of aniline and combinations thereof, and include a dopant incorporated therein.

The dopant may be, but is not limited to 2-naphthalene sulfonic acid, dodecyl benzensulfonic acid sodium salt, anthraquinone-2-sulfonic acid, or other sulfonic acids or their sodium or other salts (chloride, perchlorate, sulfonate). A preferred monomer is pyrrole which upon polymerization forms polypyrrole, and a preferred dopant is anthraquinone-2-sulfonic acid, sodium salt.

The electrically conductive paper may be used in many different applications. One particularly useful application is for economical packaging material for products which require protection from static electrical buildup. Thus the conductive paper may be used as a packing material.

Quite surprisingly, it has been discovered that by forming the composites made of the modified fibers as conductive fillers, less monomer (therefore, in turn, less conductive polymer) is needed to achieve the same conductivity while a higher tensile strength in the paper was attained when comparing with paper obtained exclusively from modified fibers. This unexpected result shows that conductive papers can be produced by retrofitting existing paper making operations to mix a small percentage of modified cellulose with unmodified cellulose during the paper making process to produce conductive paper in an economical manner.

Broadly, the present invention also provides a method of producing an electrically conductive paper composite, which includes modifying cellulose fibers to bind an electrically conductive polymer to a surface thereof to form modified cellulose fibers followed by mixing the modified cellulose fibers with unmodified cellulose fibers, in which the modified cellulose fibers are present in an amount in a range from about 0.5 to about 20% by weight to form a composite cellulose mixture. The composite cellulose mixture is then formed into paper sheets.

The step of modifying cellulose fibers to bind an electrically conductive polymer to a surface thereof includes mixing a monomer of the polymer with a dopant and the cellulose fibers, and initiating polymerization of the monomer in the presence of the dopant to form the electrically conducting polymer on the cellulose fibers to produce the modified cellulose fibers.

In one embodiment the method includes mixing the cellulose fibers with a ferric chloride hexahydrate solution, and agitating the mixture to break up the cellulose fibers and disperse the ferric chloride hexahydrate prior to mixing with the monomer and dopant.

Another method of producing an electrically conductive paper is to mix unmodified cellulose fibers with conductive fillers (polypyrrole-deposited fillers). Conductive fillers can be prepared by the polymerization of pyrrole on the surface of ordinary paper-making fillers such as clay, talc, zeolite and silica gel.

The invention will now be illustrated using the following non-limiting examples.

EXAMPLE 1

The cellulose fibers used in this Example include dried hardwood Bleached Chemi-thermo Mechanical Pulp (BCTMP) provided by a mill in Quebec; unbleached Kraft softwood pulp, softwood BTMP pulp, low freeness softwood Thermo-Mechanical Pulp (TMP) pulp from Eastern Canadian mills; unbleached sulfite hardwood pulp from a mill in U.S.; unbleached sulfite softwood pulp from a mill in Eastern Canada. Pyrrole (98%, Aldrich) was distilled and then refrigerated before use. Ferric chloride hexahydrate (98%, Aldrich), 2-naphthalene sulfonic acid (NSA, technical, 70%, Aldrich), dodecylbenzensulfonic acid, sodium salt (DBSA, technical, Aldrich), anthraquinone-2-sulfonic acid, sodium salt (AQSA, ≧98%, Fluka) were used as received. Deionized water was exclusively used for all solutions and pulp suspension throughout this study.

To prepare polypyrrole-engineered fibers, pulp fibers were put in a polyethylene bag with the addition of $FeCl_3$ (Ferric chloride hexahydrate, 98%, Aldrich) solution, followed by intense hand kneading to disperse the chemical and to disintegrate pulp. The mixture was then placed in a 25° C. water bath for temperature control. Subsequently, dopant (anthraquinone-2-sulfonic acid, sodium salt, (AQSA), ≧98%, Fluka) slurry and pyrrole (98%, Aldrich, distilled and then refrigerated before use) solution were added to start the polymerization. The additions of dopant and pyrrole were completed by four equal batches, with gentle kneading after each addition and during the reaction. The ultimate fibers consistency of the reaction system was ≈7.0% (fiber:water=0.075 g/g), and the molar ratio of $FeCl_3$ to pyrrole and molar ratio of dopant to pyrrole were 3:1 and 1:3, respectively (according to the previous reaction optimization study (Huang et al., 2005). The calculated concentration of pyrrole before the polymerization ranged from 0.02M to 0.09M, depending on the pyrrole dosage. After 1 hour, the reaction was stopped by firstly diluting the reaction mixture with ample amount of deionized water and subsequent filtering. The modified fibers were again diluted, filtered and washed for three times to remove residual reactants before sheet preparation.

For each experiment, 60 g/m$^2$ paper sheets for physical property testing and 100 g/m$^2$ paper sheets for conductivity evaluation were formed according to TAPPI methods. Deionized water was exclusively used for pulp suspension throughout this study. All paper samples were dried, conditioned (for 24 hours before any physical testing) and tested in the standard environment (72±2° F. and 50±2% RH). The conditioned paper sheets generally had moisture contents of 6-8%. A four-wire method was used to measure the resistivity of paper according to ASTM standard D991, with a Keithley Model 2750 multimeter and a custom-made four-wire test fixture. Electric current was applied to the paper strip from a pair of current probes compressing one end of the strip (against each other), and then it "flowed" through the paper strip towards another pair of current probes compressing the other end. Two voltage probes were situated in between with a distance L, touching one face of the paper strip. Voltages across the voltage probes (along the length direction of paper strip) were monitored by the electrometer. Resistance (R) along the length direction of paper strip was used to calculate the volume resistivity. The test fixture was configured (based on the ASTM standard) so that the current passes through the whole cross-section of the paper rather than through the "conductive skin" on the paper surface. Due to the limitation of the instrument, resistivities higher than $5\times10^5$ Ω·cm could not be determined. Resistivity measured 24 hours after sheet formation was designated as the (initial) resistivity of the particular sample. After the resistance measurement, the paper strips were put into a labeled polyethylene bag, and stored in the standard environment. Long-term aging stability data was obtained by evaluating stored samples' conductivities in the same testing environment with an interval of one month.

A LECO CNS-2000™ carbon, nitrogen and sulfur analyzer was used to determine the N, S contents in the obtained conductive paper since these two elements correspond to the pyrrole repeating unit and aryl sulfonate (dopant), respectively, and thus were used as indicators of the conductive polymer content.

FT-IR spectra were collected with a Thermo Nicolet NEXUS® 470 FT-IR spectrometer. A Leisa DMRA Fluorescence Microscope equipped with a Leisa DC 500 digital camera was used for the optical and fluorescence microscopy (by adopting a DAPI filter) investigation.

Composites Made Exclusively from Modified Cellulose Fibers

Figure 1B:
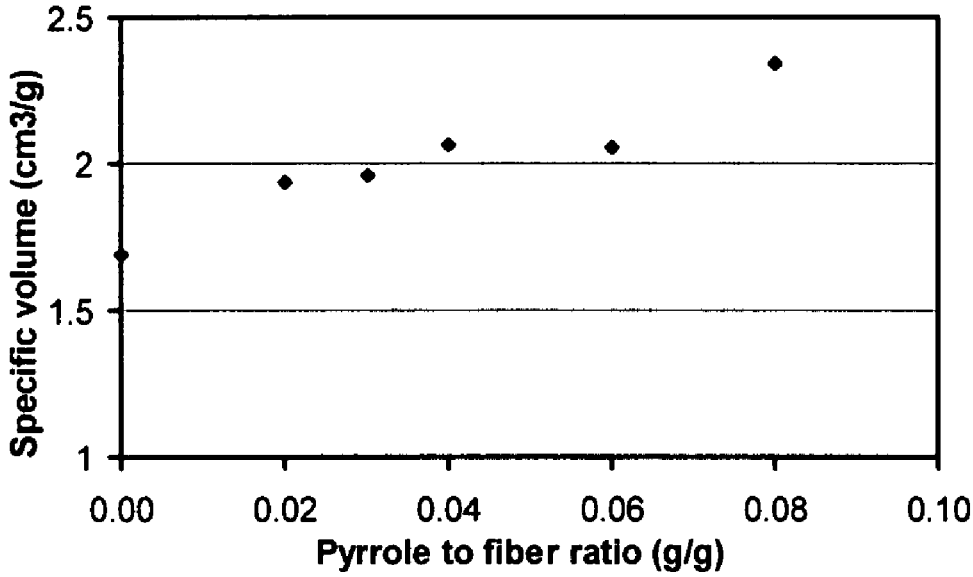
FIG. 1*b* shows the specific volume of the paper sheets of FIG. 1*a;*

BCTMP fibers modified with conductive polypyrrole can be directly formed into paper sheets through conventional papermaking practice. It can be seen in FIGS. 1*a* and 1*b* that the properties of the paper composites are closely related to the monomer dosage and thus the polypyrrole content on fibers after the modification: with increasing pyrrole dosage, the retention of conductive polymer on fibers increases linearly with the monomer dosage, and the paper resistivity drops from $10^{12}$~$10^{16}$ Ω·cm$^8$ to $3.1\times10^5$ Ω·cm at 2% pyrrole charge. Because of the gradual loss of fiber-fiber hydrogen-bonding ability (with the fiber surface being covered up by conductive polymer), tensile strength of the paper decreased significantly and the paper bulk increased (FIG. 1*b*). The decrease in tensile strength and the increase in bulk have been found to accompany the resistivity decrease throughout this study as a general rule.

Monomer dosage beyond 0.08 g per gram of pulp was not examined. This is because, upon further dosage increase, the increase in conductivity would be less pronounced while the paper strength would become so low that the paper could barely be used for practical purposes.

Composites Made From a Mixture of Treated and Untreated Fibers

As has been shown before[7], the black-colored polypyrrole deposit onto cellulose fibers regardless of the monomer dosage. It is believed that as long as the fibers undergo the polypyrrole deposition process, surface coverage by polypyrrole and the subsequent loss of hydrogen bonding ability occurs.

However, if only a portion of the total fibers in a paper matrix are modified with conductive polymer while the remaining fibers possess superior fiber-fiber bonding ability, it is possible to achieve good paper strength.

Figure 2A:
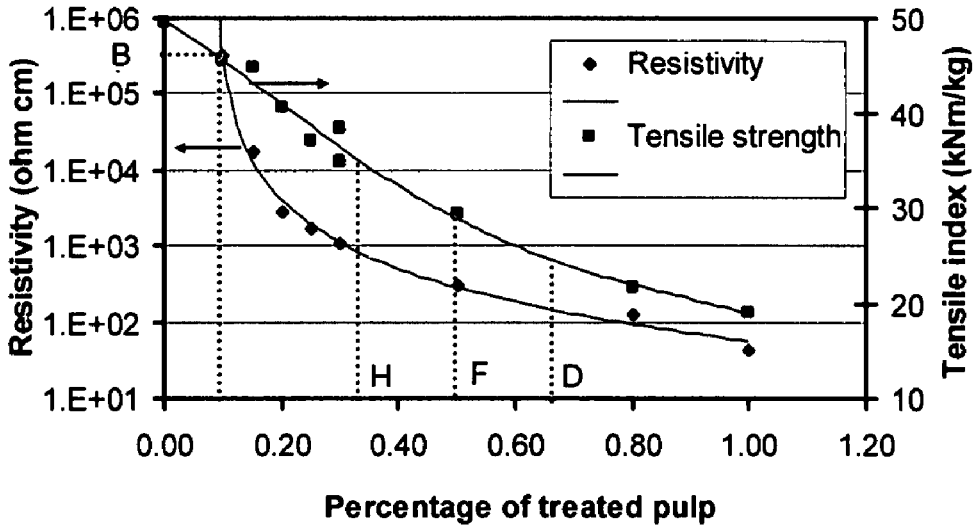
FIG. 2*a* shows plots of the electrical resistivity and tensile strength as a function of percentage of treated pulp of paper sheets made from mixture of modified (or treated) fibers to render them electrically conducting and unmodified fiber at different weight fractions, reaction conditions for the treated fibers: pyrrole dosage based on fiber (o.d) (g/g)=6:100.
Figure 2B:
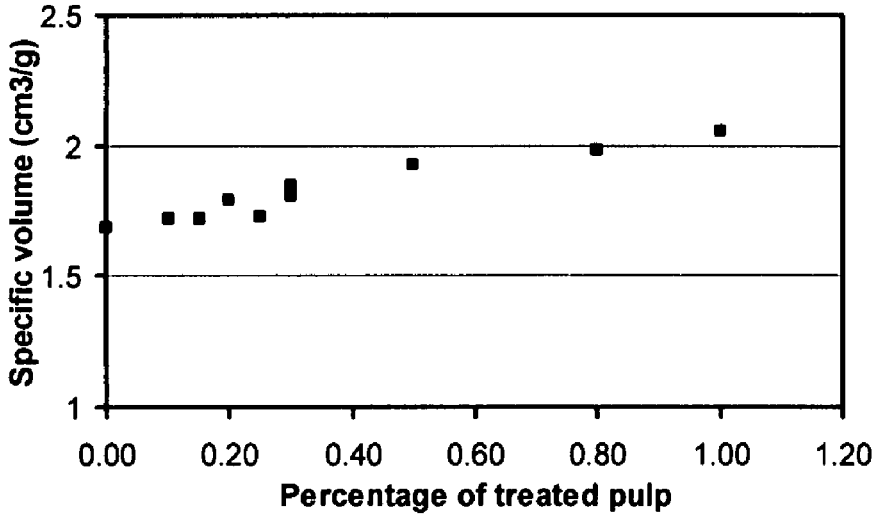
FIG. 2*b* shows the specific volume as a function of percentage of modified pulp (cellulose) of the paper sheets of FIG. 2*a;*

The scheme of mixing modified fibers with untreated fibers in an attempt to obtain electrical conductivity is disclosed herein. Fibers modified at a pyrrole dosage of 0.06 g/g fiber (o.d.) were well blended (after washing) with unmodified BCTMP fibers at different weight percentages (based on oven-dried intrinsic fiber, not including the polymer retained) into uniform pulp slurry, and then made into hand sheets following the same procedures. The results are shown in FIGS. 2*a, b*. The trends in conductivity, tensile strength and bulk with increasing modified fiber fraction were very similar to those obtained with increasing monomer dosage (FIGS. 1*a, b*). However, comparing FIG. 1*a* and FIG. 2*a*, the mixing method requires less amount of monomer to achieve the same level of resistivity while producing stronger paper. For example, comparing point A (FIG. 1*a*) and point B (FIG. 2*a*) (both about $3\times10^5$ Ω·cm), monomer dosage is of 0.02 g/g o.d (oven drying) fiber when using modified fibers alone (corresponding to Point G in FIG. 1*a*) while only about 10% of 0.06 g/g or 0.006 g/g o.d. fiber was required to obtain the same resistivity if mixing with unmodified fibers. Correspondingly, the paper tensile index of the former (25 kNm/kg in FIG. 1*a*) is significantly lower than that of the latter (46 kNm/kg in FIG. 2*a*). From another perspective, with the same amount of monomer used (based on pulp fibers), paper composite obtained through the mixing method had higher conductivity while having higher tensile strength. The differences in conductivity and paper strength between these two methods are more pronounced at lower monomer usages. For example, for the following three pairs of samples (each pair has the same monomer usage): point C and point D (4 g pyrrole used/100 g cellulose fibers), point E and point F (3 g pyrrole used/100 g cellulose fibers), point G and point H (2 g pyrrole used/100 g cellulose fibers), the differences in conductivity and tensile strength between these two methods are in the order of (G vs. H)>(E vs. F)>(C vs. D).

The finding that much less monomer or conductive polymer is needed for producing conducting composite papers using a mixture of modified and unmodified fibers to achieve conductivity similar to that of conducting paper produced using 100% modified fibers is of considerable industrial significance and of technological interest. A useful conclusion from the above results is that a good conductivity can be achieved without conductive polymer on all the fibers, but only a fraction of them. Through mixing with fibers modified at high or low monomer dosage (heavily or lightly modified), it is possible to tune the resistivity and strength properties in a wide range and with great flexibility.

Stability of Electrical Conductivity

Due to the incorporation of polypyrrole, such paper composites exhibit an aging effect associated with this intrinsically conducting polymer. The decrease in conductivity during aging under environmental conditions can be caused by several factors with different mechanisms, i.e. polymer oxidation/degradation (by oxygen[9,10]; and moisture[11] and the reduction in the amount of doping species (polypyrrole doped with mineral anions such as $Cl^-$, $BF_4^-$, $ClO_4^-$, may undergo a dedoping process due to decomposition and/or removal of the anion, or due to the reaction of the polymer backbone with the anion or its fragments)[9]. Even for arylsulfonate dopants, which greatly enhance the stability, dopant volatilization (i.e. dedoping) still exists[9].

Figure 3:
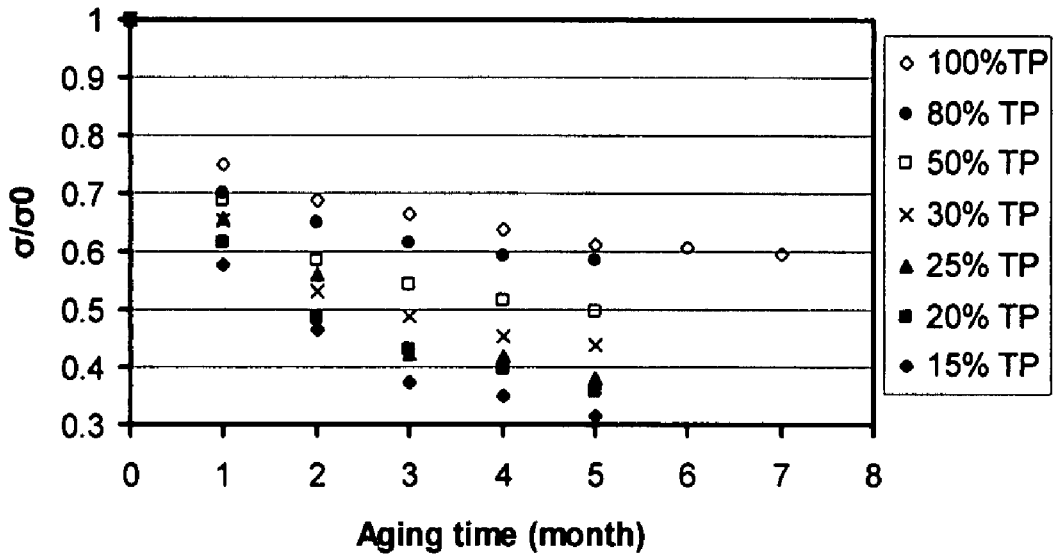
FIG. 3 is a graph showing the long term conductivity decay of paper sheets made from mixtures of modified fibers and unmodified fibers, the aging data were obtained by using the same samples in FIG. 2; TP means treated fiber.
Figure 4:
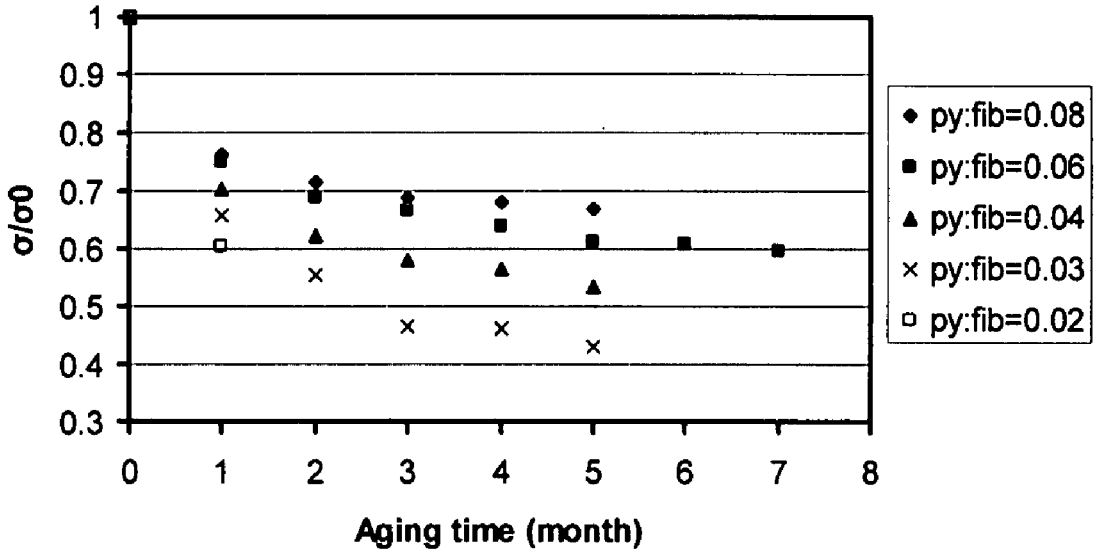
FIG. 4 is a graph showing the long term conductivity decay of paper sheets made from fibers modified with different monomer (pyrrole) dosages, aging data were obtained with the same samples in FIG. 1; py means pyrrole, fib means fiber (oven dried)
Figure 5:
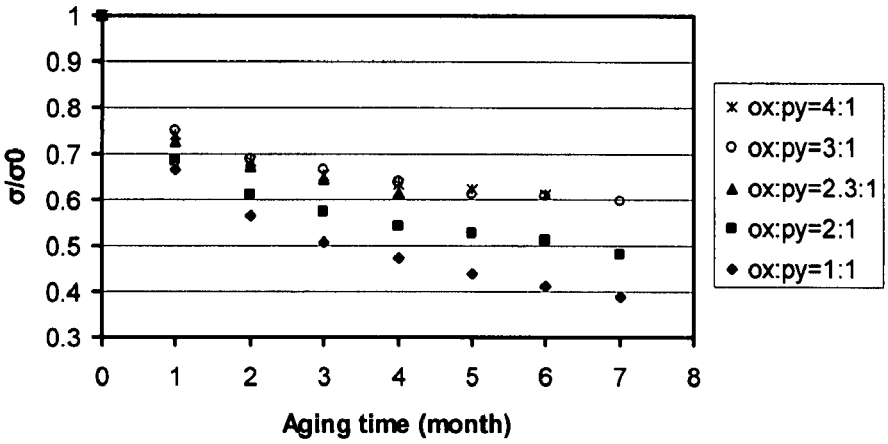
FIG. 5 is a graph showing long term conductivity decay of paper sheets made from fibers modified with different oxidant ($FeCl_3$) to monomer molar ratios, ox means oxidant ($FeCl_3$); Pyrrole dosage based on o.d fiber (g/g)=6:100.

Our research demonstrated that[12], compared with other two arysulfonate dopants, 2-naphthalene sulfonic acid and dodecylbenzensulfonic acid, anthraquinone-2-sulfonic acid (AQSA) imparted the best aging stability to the polypyrrole modified paper, probably due to the more planar structure of the AQSA molecule and thus higher packing density of the doped polymer that inhibited the diffusion of oxygen and moisture. During the aging experiment, paper samples were subjected to controlled environmental aging (72±2°° F. and 50±2% RH). It was found that as the percentage of modified fibers in the mixture was decreased, the conductivity stability of the overall paper sheet decreased as well (FIG. 3) (half time $t_{1/2}$ of longer than 9 months for paper containing 100% modified fibers while of less than 2 months for paper with 15% modified fibers). Similar trends were found for paper made from fibers modified with various monomer dosages (FIG. 4) or with various oxidant-to-monomer ratios (FIG. 5) (at a fixed monomer dosage, the polypyrrole yield on fibers is directly related to the oxidant-to-monomer ratio before reaching a maximum up to a ratio of 3[12]).

These aging results indicate that samples with lower polypyrrole contents undergo faster conductivity decays. The rates of conductivity decay are comparable for papers with similar polypyrrole contents (due to the limited data and instrument limitation, comparisons were made only for polypyrrole contents of about 0.02-0.04 g/g fiber). It is believed that the dopant, the compact conductive polymer deposition and surrounding modified fibers would all behave like protection or shield against penetration of oxygen and moisture and reduce the rate of the polymer degradation. Such protection can also be effective to hinder the removal of doping species by creating a barrier. As the percentage of modified pulp decreased or the polymer deposition (either the concentration or impregnation thickness) decreased, such protection effects would get weaker. As a result, it would be expected that faster oxidative degradation and dedoping will occur since cellulose fibers are porous and have high affinity for moisture.

EXAMPLE 2

The cellulose fibers used included dried hardwood BCTMP pulp provided by a mill in Quebec; unbleached Kraft softwood pulp, softwood BTMP pulp, low freeness softwood TMP pulp from Eastern Canadian mills; unbleached sulfite hardwood pulp from a mill in the U.S.; unbleached sulfite softwood pulp from a mill in Eastern Canada. It will be understood these are exemplary only and other cellulose fibers may be used as well. Pyrrole (98%, Aldrich) was distilled and then refrigerated before use. Ferric chloride hexahydrate (98%, Aldrich), 2-naphthalene sulfonic acid (NSA, technical, 70%, Aldrich), dodecylbenzensulfonic acid, sodium salt (DBSA, technical, Aldrich), anthraquinone-2-sulfonic acid, sodium salt (AQSA, ≧98%, Fluka) were used as received. Deionized water was exclusively used for all solutions and pulp suspension.

The FT-IR ATR spectra of such modified fibers confirmed the presence of doped polypyrrole on pulp fibers. The in-situ polymerized polypyrrole has good adhesion to fibers, and it can even survive a 1000-revolution PFI refining (refining consistency: 2.4%).

Such modified fibers function as a polypyrrole-pulp hybrid material, and behave similarly as conventional pulp fibers: they can be made into paper sheets directly by using the same paper-making facilities for conventional pulps, and thus formed paper sheets have the special property of being electrically conductive, and its conductivity of up to $3.2\times10^{-2}$ S/cm can be achieved with pyrrole dosage of only 0.06 g per gram of BCTMP fibers and a 5 minutes reaction time at 25° C. In contrast, the conductivity of conventional paper is usually $10^{-12}$~$10^{-16}$ S/cm.[8] Although the hydrogen bonding of cellulose fibers after the treatment is reduced (for the sample mentioned above, tensile index decreased to 19.26 kNm/kg, compared with 49.53 kNm/kg for the unmodified fibers), the inferior bonding can be compensated for by mixing with unmodified fibers (discussed later) or the reinforcement of other layers in the paper structure.

Process Optimization

As shown in Table I, higher conductivities can be attained when increasing the pulp consistency in the reaction system (thus increasing the reactant concentration) due to the higher polypyrrole yields on fibers that were achieved. For lower consistency systems, significant amount of unreacted monomers and low molecular weight oligomers were left in the filtrate as a result of the lower polymerization rate determined by the lower reactant concentrations. Notably, very high doped polypyrrole retention (as much as 97% of the pyrrole and 44% of the dopant) was obtained at medium consistency (MC) conditions. Nevertheless, further increase in fiber consistency is not suggested for two reasons: firstly, with almost no margin left for additional increase in polymer yield, the conductivity reaches maximum under the MC conditions; secondly, the fast polymerization reaction would make efficient and timely mixing even more difficult and might finally lead to quality variation among products.

TABLE I

EFFECT OF PULP CONSISTENCY ON ELECTRICAL RESISTIVITY AND N, S CONTENTS

| | Fiber type | | | | | |
|---|---|---|---|---|---|---|
| | Refined Kraft fiber* | | Kraft fiber | | BCTMP | |
| Fiber:water (g/g) | 0.005 | 0.01 | 0.005 | 0.01 | 0.01 | 0.1 |
| Resistivity (Ω · cm) | >$4.61\times10^5$ | $2.40\times10^4$ | $1.99\times10^5$ | $4.49\times10^3$ | $6.47\times10^2$ | $3.74\times10^1$ |
| Retention of pyrrole (%) | 70.45 | 80.53 | 74.91 | 86.82 | 66.24 | 96.70 |
| Retention of dopant (%)** | 27.76 | 38.87 | 33.45 | 37.40 | 29.06 | 43.96 |

Figure 6A:
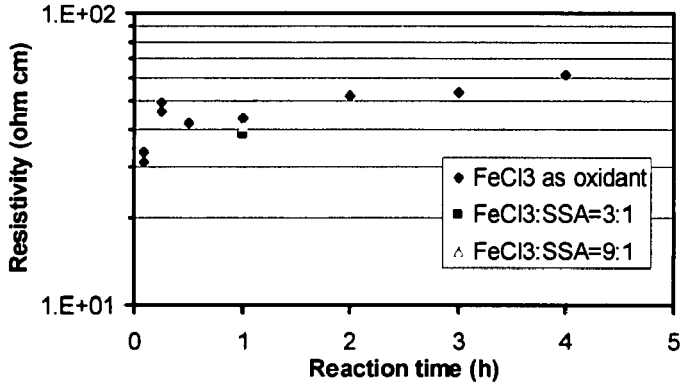
FIG. 6*a* is a graph showing the electrical resistivity of paper sheets made from BCTMP Fibers Treated with Different Time, Reaction conditions: AQSA to pyrrole mole ratio=1:1; fiber to water ratio (g/g)=0.075; 25° C.; other conditions same as those in Table I (SSA in FIG. 6*a* means 5-sulfosalicylic acid)
Figure 6B:
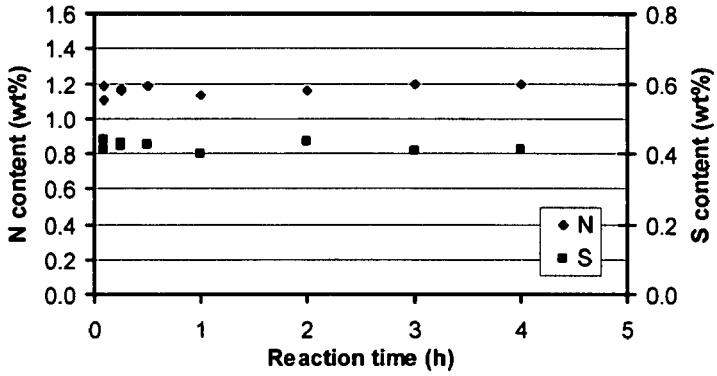
FIG. 6*b* is a graph showing nitrogen (N), sulfur (S) contents of the paper sheets of FIG. 6*a;*

Other reaction conditions: pyrrole dosage based on fiber (o.d) (g/g) = 6:100; $FeCl_3$ to pyrrole ratio (mole/mole) = 3:1; NSA to pyrrole mole ratio = 1:1 (NSA used as dopant); ice bath; 4 hour reaction time;
*Refined in laboratory in a PFI with 5000 revolution (TAPPI method); 440 CSF (at 20° C.) after refining;
**Calculated based on the amount of dopant theoretically needed;

Although most of the polypyrrole synthesis via chemical path reported in literature was carried out with duration of several hours, it was found in this study that a polypyrrole yield readily leveled off (nearly 100%) in 5 minutes and resistivity as low as $3.11\times10^1$ Ω·cm was achieved (FIG. 6). Evidently, the polymerization reaction at MC condition is fast. As the reaction time gets longer, the conductivity is partially lost, which might be due to the over-oxidation[13] or other side reactions of the formed polymer (thus inducing more defects and shorter conjugated length)[14].

Figure 7A:
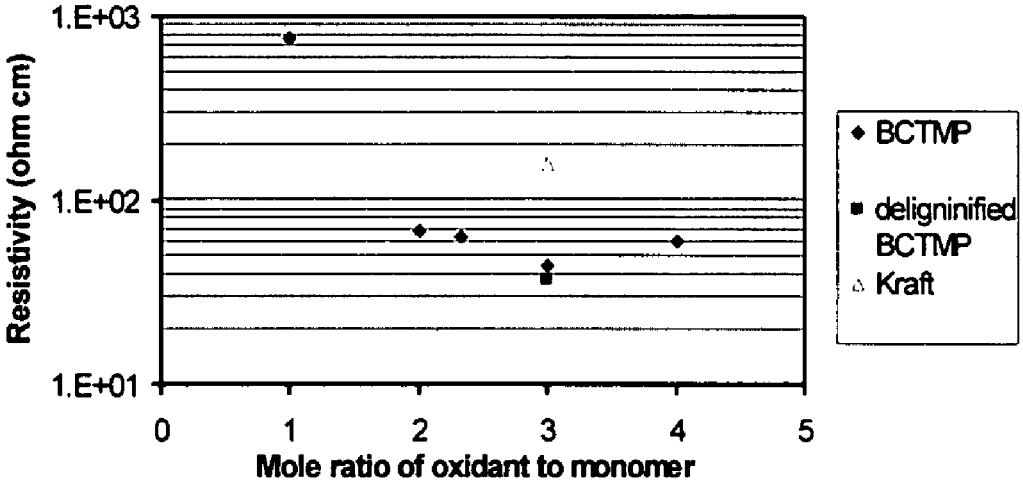
FIG. 7*a* is a plot showing the electrical resistivity of paper sheets made from Bleached Chemithermo Mechanical Pulp (BCTMP) fibers treated with different $FeCl_3$ to monomer ratios, reaction conditions: 1 hour reaction time; other conditions same as those in FIG. 6*a;*
Figure 7B:
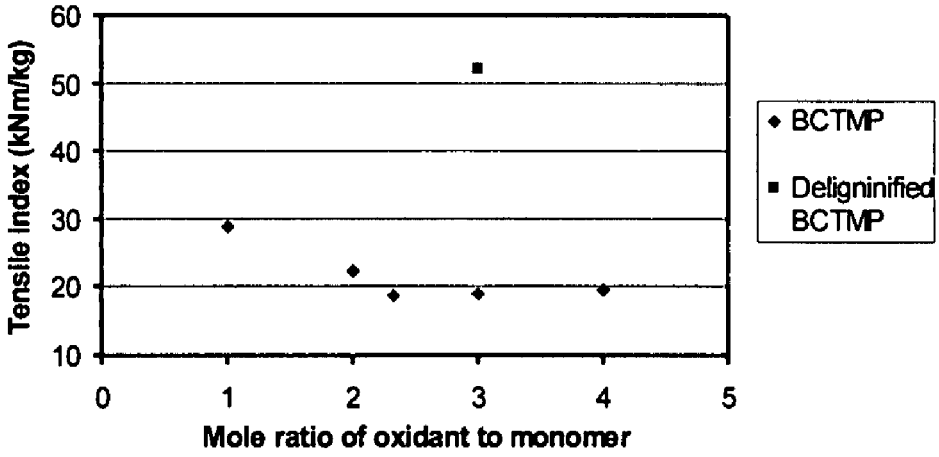
FIG. 7*b* is a plot showing the tensile strength of the fibers of FIG. 7*a*.
Figure 7C:
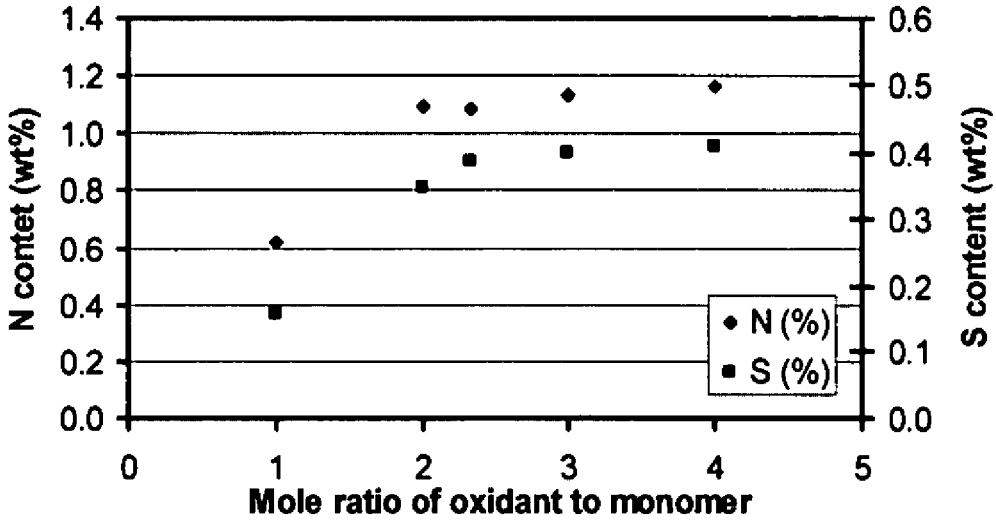
FIG. 7*c* is a plot showing the N, S contents of the paper sheets of FIG. 7*a*.

The resistivity is strongly dependent on the oxidant-to-monomer ratio of the reaction system, with a minimum achieved around 3 (FIG. 7*a*). The reason lies in the fact that this ratio stoichiometrically determines the conversion of monomers to doped polymers and thus the yield of conductive polymer on fibers (as indicated by the corresponding elemental analysis results in FIG. 7*c*). In other words, the strong dependence of resistivity on this ratio was actually a dependence on the polymer retention. As the polymerization reaction follows a step-growth mechanism, it requires two $Fe^{+3}$ for every repeating unit (pyrrole ring) for chain formation and additional one $Fe^{+3}$ for every three repeating unit for further chain oxidation (doping)[15,16,17]. The slight increase in resistivity at $FeCl_3$-to-pyrrole ratio of 4 might be due to the over-oxidation of polypyrrole. It should be pointed out that, in the current study, the overall paper conductivity relies upon not only the conductivity of polypyrrole but also the polymer content in the material. However, the improvements in conductivity through reducing side reactions (e.g. by lowering the oxidant to monomer ratio) are much smaller compared to the changes caused by polypyrrole retentions.

Among all the tested pulps, BCTMP fibers show superior response to the treatment in terms of their achievable conductivity. However, since acid chlorite delignified BCTMP pulp shows almost identical paper resistivity but much higher. tensile strength after the same in-situ polymerization treatment (FIGS. 7*a, b* and *c*); the existence of sulfonated lignin in BCTMP fiber, which could possibly act as self-dopant for the conductive polymer, has negligible influence on conductivity. Generally, mechanical pulps are better than chemical pulps in this regard. It is possible that the dissimilarities in morphology and physical properties of different types of fibers play the key role.

Although lower polymerization temperatures usually bring about more conductive polymers, a compromise reaction temperature of 25° C. was used to eliminate refrigeration. The conductivity improvement obtained through forming weak $Fe^{+3}$ complex with complexing agent 5-sulfosalicylic acid (to control the release of oxidant) is limited (FIG. 6*a*), and it can be readily achieved by shortening the reaction duration.

Compared with the other two arylsulfonate dopant NSA and DBSA, AQSA gives the best performance in achieving high conductivity as well as the best aging stability (half-time much longer than 9 months). With an optimal AQSA to monomer molar ratio of 1:3, the doping degree (S to N mole ratio) is about half of the expected value 0.33, attributable to the incorporation of $Cl^-$ as counter-ions. Such unavoidable large existence of $Cl^-$ doping species would reduce the achievable conductivity as well as the attainable aging stability, since the solely $Cl^-$ doped sample was found to be inferior in both aspects.

After a reasonable wet pressing period (readily incorporated in paper-making process), the composite paper shows little response to further pressing with regard to the improvement in conductivity. High temperature drying is favorable provided that the drying period is kept short and excess heating is minimized.

EXAMPLE 3

Preparation of Polypyrrole-deposited Clay 10 g of clay (Imery Kaolin) and 12.1 g of $FeCl_3.6H_2O$ was placed in a 1 L 3-neck round flask, followed by 300 ml of deionized water. The flask was placed in an ice-water bath. The content was stirred magnetically under $N_2$. 1.0 g of pyrrole and 1.47 g of AQSA was dissolved in 200 mL $H_2O$ and transferred to a 500 mL dropping funnel. Once $FeCl_3$ was completely dissolved, pyrrole and AQSA were added dropwise over a period of 2 hours. It was stirred for 2 extra hours after the addition of pyrrole and AQSA. The temperature was maintained at about 5° C. throughout the reaction. The black powder was collected by filtration and thoroughly washed with de-ionized water. The reaction product, which is in the form of wet powder will be used without drying. Three samples of polypyrrole-deposited clay (10%, 20%, 30% of pyrrole on clay) were prepared by this procedure.

Preparation of Conductive Paper by Adding Polypyrrole-deposited Clay to Pulp

In a 1 L beaker, 2.0 g (o.d.) of high yield pulp (HYP) was disintegrated with stirring at 0.5% pulp consistency. The desired amount of polypyrrole-deposited clay was added. The mixture was stirred for 1 min. Percol 292 (functioning as a retention aid, 0.1% on pulp) was added and the pulp slurry was stirred for another min. Paper handsheets were made by following the Tappi standard method. The handsheets were conditioned and the resistivity was measured in the same manner described in Example 1. The pyrrole content of these handsheets was determined by nitrogen analysis. The resistivity of the conductive paper with polypyrrole-deposited clay and paper composite is shown in Table 2.

| 10% pyrrole on clay | | 20% pyrrole on clay | | 30% pyrrole on clay | |
|---|---|---|---|---|---|
| Pyrrole on pulp (%) | Resistivity (ohm · cm) | Pyrrole on pulp (%) | Resistivity (ohm · cm) | Pyrrole on pulp (%) | Resistivity (ohm · cm) |
| 2.46 | 955 | 2.48 | 1868 | 2.52 | 2152 |
| 2.97 | 343 | 3.03 | 633 | 3.07 | 657 |
| 3.25 | 202 | 3.47 | 331 | 3.52 | 366 |
| 3.62 | 113 | 3.72 | 177 | 3.92 | 208 |

Conductive paper prepared in this way with the modified particulate filler present amount in a range from about 3 to about 40% by weight gave useful conductive paper.

Conductive paper composites may also be made using a combination of cellulose modified to be conducting, unmodified cellulose and particulate paper filler modified to be conductive, and optionally unmodified particulate paper filler.

As used herein, the terms "comprises", "comprising", "including" and "includes" are to be construed as being inclusive and open ended, and not exclusive. Specifically, when used in this specification including claims, the terms "comprises", "comprising", "including" and "includes" and variations thereof mean the specified features, steps or components are included. These terms are not to be interpreted to exclude the presence of other features, steps or components.

The foregoing description of the preferred embodiments of the invention has been presented to illustrate the principles of the invention and not to limit the invention to the particular embodiment illustrated. It is intended that the scope of the invention be defined by all of the embodiments encompassed within the following claims and their equivalents.

REFERENCES

1. BAUM, G. A., The key to industry change, *Solutions,* 85, 42 (2002)
2. WAGBERG, L., FORSBERG, S., JOHANSSON, A., JUNTTI, P., Engineering of fiber surface properties by application of the polyelectrolyte multilayer concept. Part I: Modification of paper strength, *Journal of Pulp and Paper Science* 28, 222 (2002).
3. HEEGER, A. J., Semiconducting and metallic polymers: The fourth generation of polymeric materials, *Journal of Physical Chemistry B,* 105, 8475 (2002).
4. KUHN, H. H., Adsorption at the liquid/solid interface: conductive textiles based on polypyrrole, *Textile Chemist and Colorist,* 29, 17 (1997).
5. BJORKLUND, R. B., Lundstrom, I., Some properties of polypyrrole-paper composites, *Journal of Electronic Materials,* 13, 211 (1984).
6. OKA, O., YOSHINO, K., and KISHIWADA-SHI., Composite comprising paper and electro-conducting polymers and its production process, Tomoegawa Paper Co. Ltd., U.S. Pat. No. 5,336,374, 1994.
7. Huang, B., Kang, G. J., Ni, Y., Preparation of conductive paper by in-situ polymerization of pyrrole in a pulp fiber system, Pulp & Paper Canada, 107 (2):T38-T42 (2006).
8. NISKANEN, K., YHDISTYS, S. P., Technical Association of the Pulp and Paper Industry, *Paper physics*, Published in cooperation with the Finnish Paper Engineers' Association and TAPPI, Helsinki; Atlanta, 1998.
9. THIEBLEMONT, J. C., GABELLE, J. L., PLANCHE, M. F., Polypyrrole overoxidation during its chemical synthesis, *Synthetic Metals,* 66, 243 (1994).
10. Truong, V. T., Thermal-Degradation of Polypyrrole-Effect of Temperature and film Thickness, *Synthetic Metals,* 52, 33-44 (1992).
11. Erlandsson, R., Inganas, O., Lundstrom, I., Salaneck, W. R., XPS and electrical characterization of Bf4-doped polypyrrole exposed to oxygen and water, *Synthetic Metals,* 10, 303-318 (1985).
12. Huang, B., Kang, G. J., Ni, Y., Electrically conductive fiber composites prepared from polypyrrole-engineered pulp fiber, The Canadian Journal of Chemical Engineering, 83 (10): 896-903 (2005).
13. Thieblemont, J. C., Planche, M. F., Petrescu, C., Bouvier, J. M., Bidan, G., Stability of chemically synthesized polypyrrole films. *Synthetic Metals,* 1993, 59, 81-96.
14. LEI, J. T., CAI, Z. H., MARTIN, C. R., Effect of reagent concentrations used to synthesize polypyrrole on the chemical characteristics and optical and electronic-properties of the resulting paper, *Synthetic Metals,* 46, 53 (1992).
15. RAPI, S., BOCCHI, V., GARDINI, G. P., Conducting polypyrrole by chemical synthesis in water synthetic metals, *Synthetic Metals,* 24, 217 (1988).
16. PLANCHE, M. F., THIEBLEMONT, J. C., MAZARS, N., Bidan, G., Kinetic study of pyrrole polymerization with iron (III) chloride in water, *Journal of Applied Polymer Science,* 52, 1867 (1994).
17. Machida, S., Miyata, S., Techagumpuch, A., Chemical synthesis of highly electrically conductive polypyrrole, *Synthetic Metals.* 31, 311 (1989).

Therefore what is claimed is:

1. An electrically conductive paper composite, comprising: a mixture of cellulose fibers and clay particulate filler with surfaces modified to have a conductive polymer bound thereto to give conductive polymer coated clay particulate fillers, said conductive polymer including a dopant incorporated therein, said dopant being selected from the group consisting of sulfonic acids and salts thereof.

2. The electrically conductive paper composite according to claim 1 wherein said clay particulate filler is present in an amount in a range from about 3 to about 40% by weight.

3. The electrically conductive paper composite according to claim 1 including cellulose fibers modified to have a conductive polymer bound to a surface of the cellulose fibers, and optionally unmodified particulate filler.

4. The electrically conductive paper composite according to claim 3 wherein said modified cellulose fibers are present in an amount in a range from about 0.5 to about 20% by weight.

5. The electrically conductive paper composite according to claim 3 wherein said conducting polymer is made from monomers selected from the group consisting of pyrrole, substituted derivatives of pyrrole, aniline, substituted derivatives of aniline and combinations thereof.

6. The electrically conductive paper composite according to claim 3 wherein said conducting polymer is made from a monomer of pyrrole, and wherein the conducting polymer is polypyrrole.

7. An electrically conductive paper composite, comprising:

a mixture of cellulose fibers and particulate fillers selected from the group consisting of bentonite, talc and silica gel with surfaces modified to have a conductive polymer bound thereto to give conductive polymer coated particulate fillers, said conductive polymer including a dopant incorporated therein, said dopant being selected from the group consisting of sulfonic acids and salts thereof.

8. The electrically conductive paper composite according to claim 7 wherein said particulate filler is present in an amount in a range from about 3 to about 40% by weight.

9. The electrically conductive paper composite according to claim 7 including cellulose fibers modified to have a conductive polymer bound to a surface of the cellulose fibers, and optionally unmodified particulate filler.

10. The electrically conductive paper composite according to claim 8 wherein said modified cellulose fibers are present in an amount in a range from about 0.5 to about 20% by weight.

11. The electrically conductive paper composite according to claim 7 wherein said conducting polymer is made from monomers selected from the group consisting of pyrrole, substituted derivatives of pyrrole, aniline, substituted derivatives of aniline and combinations thereof.

12. The electrically conductive paper composite according to claim 7 wherein said conducting polymer is made from a monomer of pyrrole, and wherein the conducting polymer is polypyrrole.

13. An electrically conductive paper composite, comprising:

a combination of cellulose modified with a conductive polymer bound thereto to be conducting and unmodified cellulose and particulate filler modified with said conductive polymer to give conductive polymer coated particulate fillers, and optionally unmodified particulate filler, wherein the particulate filler is selected from the group consisting of clay, bentonite, talc and silica gel, and said conductive polymer including a dopant incorporated therein, said dopant being selected from the group consisting of sulfonic acids and salts thereof.

* * * * *